United States Patent [19]

Cheng

[11] Patent Number: 4,827,243

[45] Date of Patent: May 2, 1989

[54] IMPROVED STRUCTURE OF COMPUTER KEYBOARD AND CIRCUIT BOARD

[76] Inventor: Sheng-chuang Cheng, 6 Fl., Lane 166, Wenlin N. Rd., Peitou Dis., Taipei, Taiwan

[21] Appl. No.: 124,487

[22] Filed: Nov. 23, 1987

[51] Int. Cl.[4] ..... H01H 3/14

[52] U.S. Cl. ..... 341/22; 200/345; 200/517

[58] Field of Search ..... 340/365 R, 711; 200/5 A, 5 D, 340, 159 B, 159 R

[56] References Cited

U.S. PATENT DOCUMENTS

| | | | |
|---|---|---|---|
| 4,390,765 | 6/1983 | Sado et al. | 200/159 B |
| 4,453,061 | 6/1984 | Tamura | 200/159 B |
| 4,596,912 | 6/1986 | Hattori | 200/340 |
| 4,712,092 | 12/1987 | Boldridge, Jr. et al. | 340/365 R |
| 4,735,520 | 4/1988 | Suzuki et al. | 340/365 R |
| 4,755,645 | 7/1988 | Naoki et al. | 200/340 |

FOREIGN PATENT DOCUMENTS 2058462A 4/1981 United Kingdom ..... 200/159 B

OTHER PUBLICATIONS

"Conductive Rubber Cuts Switch Cost", Electronics Magazine, Feb. 24, 1982, vol. 55, No. 4.

*Primary Examiner*—John W. Caldwell, Sr.
*Assistant Examiner*—Tyrone Queen
*Attorney, Agent, or Firm*—Roylance, Abrams, Berdo & Goodman

[57] ABSTRACT

The present invention relates to a keyboard button structure. Each button has a pair of side mounted "U" shaped plates. Holes are provided in the housing panel and protrusions are formed inside the holes to permit rapid assembly of the button into the holes, and to prevent loss of buttons. A rubber member between the button and the panel provides button return and also permits feel of the contact and comfortable operation. The invention's novel structure provides economic and other advantages.

3 Claims, 2 Drawing Sheets

IMPROVED STRUCTURE OF COMPUTER KEYBOARD AND CIRCUIT BOARD

BACKGROUND OF THE INVENTION

In most conventional computer keyboards, a foam sensor is inserted into a slot of a cylindrical shaped seat. This seat passes through the seat of a carter base. A plurality of holes are formed in the base. In each hole, a seat and a push button, mounted with a spring, are inserted. A plate for the button is also associated with each cylindrical seat. Finally, a housing is provided. These prior art structures are complicated, they involve a large number of components, and thus they are costly to manufacture.

Further, the method of mounting the button and the cylinderical seat employed a clip plate to clip the button to the seat. This mounting method is unsatisfactory because if the mounting or clipping force was insufficient, it was possible for the button to drop off during transportation. Also, if the mounting force was overly aggressive, again it was possible for the button to drop off.

Yet another disadvantage is that, due to the spring bearing on the button, the user could be fooled into thinking the operation was complete when in fact there was no operation of the foam sensor or mechanical switch. Thus, the operator had to watch the monitor to know whether or not operation of the button has achieved an input operation or not.

For conventional buttons, mechanical switches or conductive rubber capacitor types of switches are used to produce the output signals. Mechanical switches are reliable and their contacts are not effected by the weather, but their cost of installation is prohibitively high. The capacitor types, which use a metallic foil at the bottom of a foam sensor to produce a signal from the circuit board, possess the benefits of low cost and low cost of installation; however, they are effected by the weather. Oxidation of metal increases electrical resistance, which causes a poor magnetic field, which has an adverse effect on the output signal.

BRIEF SUMMARY OF THE INVENTION

Computers are presently used to operate processing equipment. These computers comprise hardware and software. The software is usually professionally designed. The hardware includes a keyboard, a monitor, disk drives, a printer, etc. The keyboard is frequently used by the operators, e.g., for programming and to input data.

The main features of the present invention are:

(1) A one-piece housing panel formed with a plurality of holes. A protrusion is formed at each lateral side of each of said holes. Between each two of said holes, a through cylinderical guide sleeve extends downwardly, and a rubber seal is provided at the lower end of each guide sleeve.

(2) Each button is formed with a "U"-shaped guide plate on each of its lateral sides. A hollow guide pin extends downwardly centrally of each button. A pawl-like seat is formed at the bottom end of each guide pin, and the foam sensor is inserted into said pawl-like seat.

(3) The lower end of the foam sensor is provided with a conductive metallic layer which cooperates with contact points welded to the underlying circuit board.

DETAILED DESCRIPTION OF THE PREFERRED EMBODIMENTS

Figure 1:
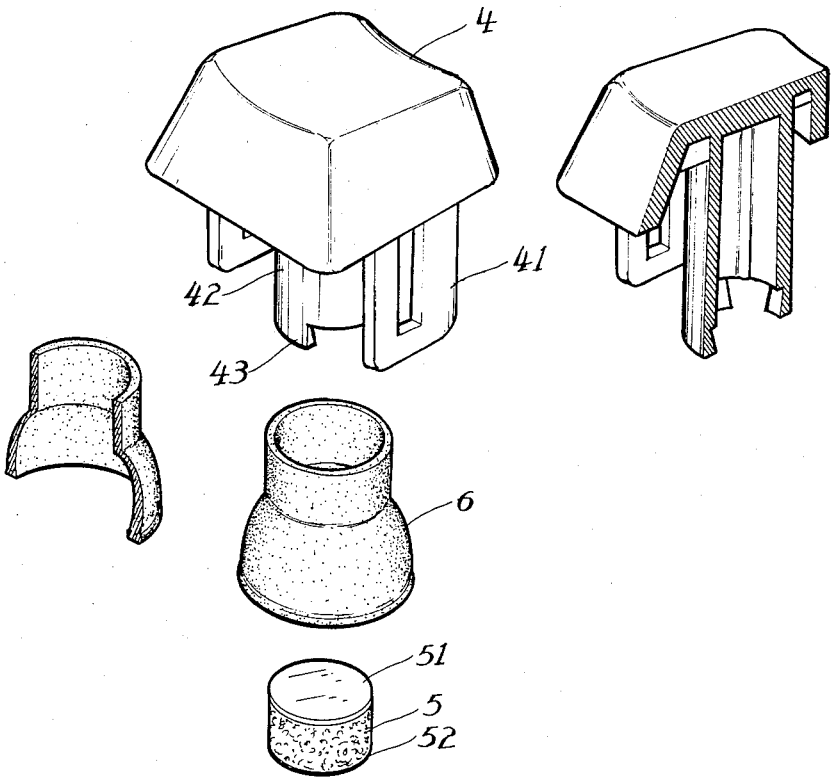
FIG. 1 is an exploded view of an assembly in according to the invention, with additional cross-sectional showings of the button 4 and the rubber body 6 to aid in understanding.
Figure 1:
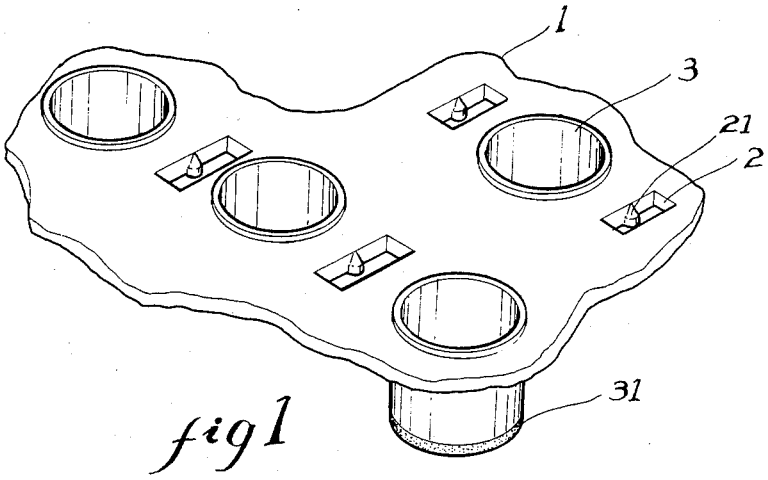
Figure 2:
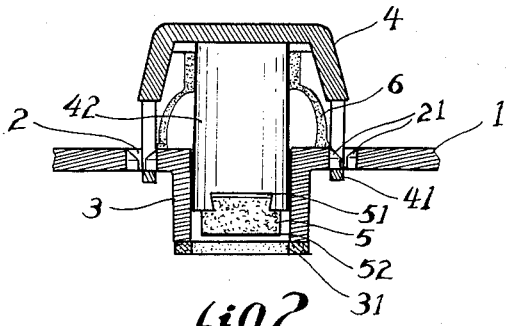
FIGS. 2 and 3 are action views showing the operation of the button assembly of FIG. 1.
Figure 3:
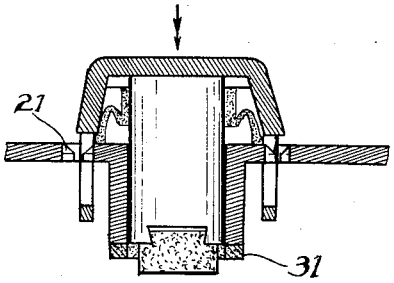
Figure 4:
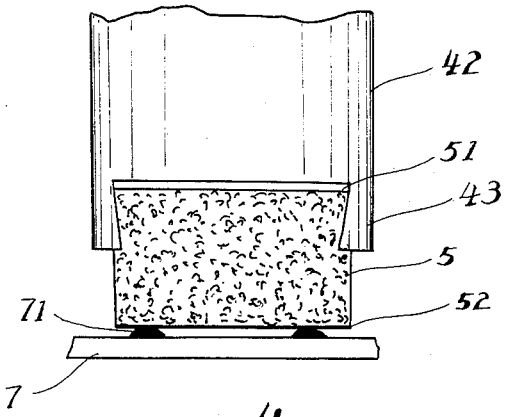
FIG. 4 is an enlarged showing of the contact between the foam sensor and the circuit board.

The present invention as shown in FIGS. 1–3 comprises a one-piece housing 1 formed in its top with an array of holes 2. A protrusion 21 is formed at each lateral side of each hole 2. Between each two holes 2 the panel 1 is formed with a downwardly extending through guide sleeve 3. A rubber seal 31 is provided at the lower end of guide sleeve 3.

Each button 4 is formed with a pair of "U"-shaped guide plates 41, one on each side of the button. Centrally, each button 4 is formed with a downwardly extending hollow guide pin portion 42. The front or bottom end of pin 42 is formed with a pawl-like seat 43 for clipping or gripping the foam sensor 5. Sensor 5 has a hard end face 51 which cooperates with seat 43 to hold the foam sensor 5 in place in pin 42.

A hollow elastic rubber body 6 is inserted between panel 1 and the underside of button 4 and around pin 42. Body 6 is formed so that it is relatively thicker at both ends and relatively thinner in the center region.

As is clear from FIGS. 2 and 3, the motion of the button 4 is guided by cooperation between the protrusions 21 and the button's guide plate portions 41. The resiliency of the plate portions 41 of the plastic button 4 permit their fitting to the protrusions 21 by being pushed thereover. There is no disengagement of the button from the protrusions after it is released or at any time in its operation.

The circuit board includes welded protruding contacts 71. A circuit is completed by each button 4, the conductive metal layer 52 of the sensor 5 bridging such contacts 71.

The features of the present invention are:

(a) Manufacture is inexpensive and convenient, and assembly is easy.

(b) The protrusions 21 prevent any disengagement of the button.

(c) Due to the central thinner region of body 6, the operator can sense the pressing of the button.

(d) The protruding contacts 71 permit the contact to the metal foil 52 to be exact, to thus guarantee an input signal. Moreover, the contact point is sealed which isolates the contacts from dust, and thus conductively can be guaranteed.

While the invention has been described in detail above, it is to understood that this detailed description is by way of example only, and the protection granted is to be limited only by the spirit of the invention and the scope of the following claims.

I claim:

1. An improved computer keyboard and circuit apparatus comprising a one-piece housing panel, an array of rectangular holes having lateral edges formed in the top of said housing panel, a protrusion formed at the lateral edges of said holes, a through downwardly extending guide sleeve provided in said housing panel between each two of said rectangular holes, a rubber seal at the lower end of said guide sleeve, a plurality of keyboard push buttons, each of said buttons comprising a pair of "U"-shaped guide plates positioned one on each lateral side of said button, said protrusions and said guide plates cooperating to both hold said button on said panel and to guide the motion of said button with respect to said panel, a hollow guide pin portion extending downwardly centrally of said button and between said guide plates, a pawl like gripping seat formed at the end of said guide pin portion, a foam sensor mounted in said gripping seat, a rubber body mounted on said guide pin portion between said button and said housing panel, said rubber body having relatively thicker walls in its end regions and a relatively thinner wall in its central region, a circuit board, contact means protruding from said circuit board towards said button, and a conductive layer at the end of said foam sensor and adapted to contact said contact means when said button is operated.

2. The apparatus of claim 1, and said foam sensor being provided with a hard end face, opposite said conductive layer, for cooperation with said gripping seat.

3. The apparatus of claim 1, wherein said seal on said guide sleeve is in contact with said circuit board, whereby said contact means are isolated from dust.

* * * * *